United States Patent [19]

Winant

[11] Patent Number: 4,875,866

[45] Date of Patent: Oct. 24, 1989

[54] LIGHT BULB SOCKET

[76] Inventor: Arnold F. Winant, 87 Susquehanna Ave., Great Neck, N.Y. 11021

[21] Appl. No.: 237,130

[22] Filed: Aug. 29, 1988

[51] Int. Cl.[4] ..... H01R 13/44

[52] U.S. Cl. ..... 439/140; 439/230; 439/232; 439/243; 439/893

[58] Field of Search ..... 439/131, 137, 139–141, 439/142, 230, 232, 243, 360, 893, 188

[56] References Cited

U.S. PATENT DOCUMENTS

| | | | |
|---|---|---|---|
| 1,224,907 | 5/1917 | Douglas | 439/737 |
| 1,328,224 | 1/1920 | Benjamin | 439/140 |
| 1,786,598 | 12/1930 | Broer | 439/265 |
| 2,392,164 | 1/1946 | Lindsay | 439/188 |
| 3,915,536 | 10/1975 | Glantz | 439/188 |
| 4,768,966 | 9/1988 | Doherty | 439/140 |

*Primary Examiner*—P. Austin Bradley
*Attorney, Agent, or Firm*—Wolder, Gross & Yavner

[57] ABSTRACT

An improved light socket for use with light bulbs of conventional design and threaded base, has a frame and a cup adapted to accept the light bulb base mounted for longitudinal motion within the frame between a first extended position and a second retracted position. Electrical contacts are provided for establishing electrical continuity with the bulb, the contacts being engaged with the bulb when the cup is in the second, retracted position and disengaged from the bulb when the cup is in the first, extended position. An engagement finger engages the bulb thread when the cup is in the retracted position to retain the bulb in the cup, and releases the bulb when the cup returns to the extended position.

7 Claims, 2 Drawing Sheets

FIG. 4
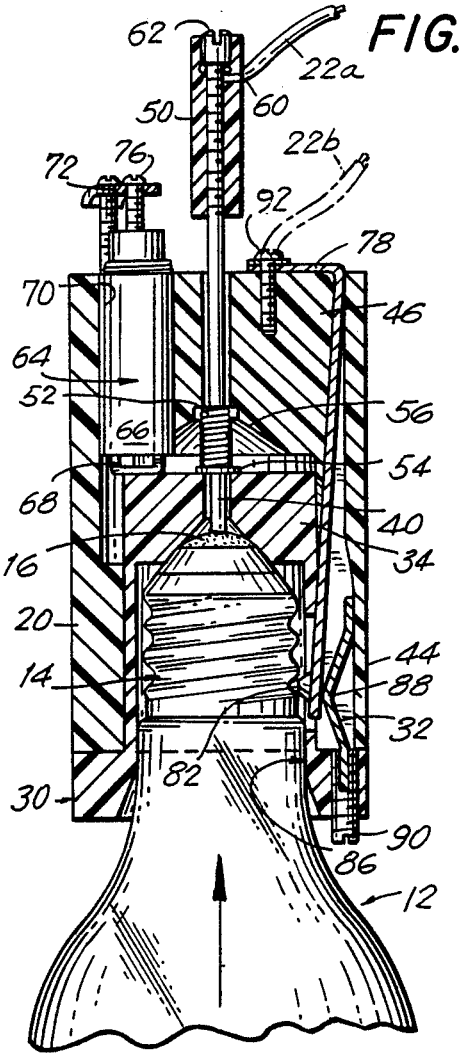
FIG. 5
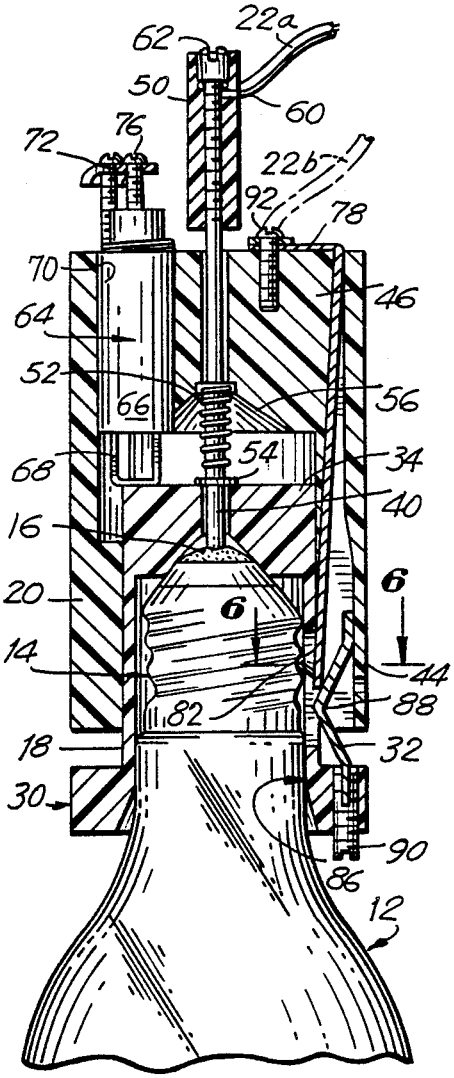
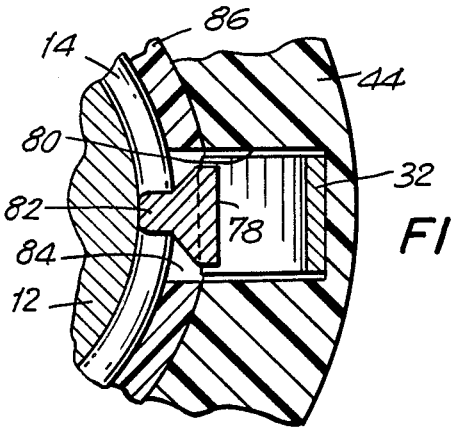
FIG. 6

LIGHT BULB SOCKET

The present invention relates to the electrical arts and, in particular, to a new and improved light bulb socket.

BACKGROUND OF THE INVENTION

The standard, general use light bulb which serves into a mating socket is a device whose installation and use is well understood. While the socket for such a bulb normally provides solid service, there are certain applications in which shortcomings of the socket become apparent.

For example, light sockets are often located in remote locations where accessibility to the socket is difficult. It thus becomes an arduous task to reach the socket and insert or remove a light bulb by the typical rotary screwing action required.

In addition, the common socket, whose interior provides a pair of exposed electrical contacts utilized to energize the bulb, often presents a tempting object for children. The insertion of a finger or hand-held object, such as a spoon or fork, can lead to tragic consequences if contact to a hot electrical conductor within the socket is made.

It is accordingly a purpose of the present invention to provide a new and improved socket for light bulbs of conventional construction and similar articles which allows for an improved method of bulb insertion and removal.

Another purpose of the present invention is to provide a new and improved socket which significantly lessens the likelihood of contact with the conductors therein, thus providing a safer product.

Yet a further purpose of the present invention is to provide the above features in a socket which is economical to manufacture.

SUMMARY OF THE INVENTION

In accordance with the above and other objects and purposes, the new and improved socket of the present invention incorporates an inner bulb-retaining cup which slides longitudinally within an outer frame between an extended and a retracted position. Latch means are provided to selectively retain the cup in the retracted position, wherein a pair of contacts project inwardly from the cup body to create and maintain electrical contact with the bulb. In addition, an engagement means engages the threads of the bulb, thus retaining the bulb in the socket and in electrical contact therewith. Release of the latch means returns the cup to the extended position, withdrawing both the electrical contacts and the engagement means releasing the bulb from the socket for removal.

With the above construction, the bulb is not screwed into the socket, but merely is inserted into the cup and a longitudinal force applied. Such a force depresses the cup into the retracted position locking the bulb in the socket and establishing electrical contact. As the electrical contact means are retracted and shielded when the cup is in the extended position, the opportunity for inadvertent electrical contact when a bulb is not inserted is minimized.

DESCRIPTION OF THE DRAWINGS

A fuller understanding of the present invention will be achieved upon consideration of the following description of a preferred, but nonetheless illustrative embodiment of the invention when taken in conjunction with the annexed drawings, wherein:

FIG. 4 is a sectional elevation view taken along line 3—3 of FIG. 2 depicting the socket when a light bulb is inserted therein;

FIG. 5 is a sectional elevation view taken along line 3—3 of FIG. 2 detailing the action of the socket when the light bulb inserted therein is being released; and FIG. 6 is a partial sectional plan view taken along line 6—6 of FIG. 5 detailing the means by which the light bulb is retained within the socket.

DESCRIPTION OF A PREFERRED EMBODIMENT

Figure 1:
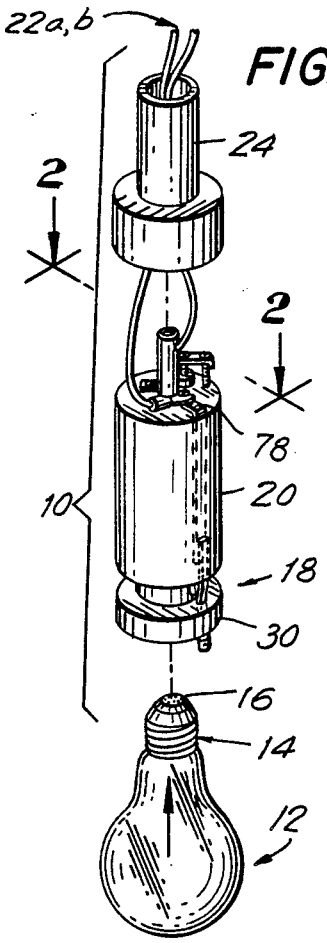
FIG. 1 is a perspective view of the socket of the present invention with a light bulb aligned for insertion therein.

Referring initially to FIG. 1, improved light bulb socket 10 of the present invention designed for utilization in connection with a conventional bulb 12 having a threaded socket-engaging base first electrical contact 14 and a central electrical contact 16 includes cup 18 adapated to receive the bulb base therein and move longitudinally within frame 20. A pair of conductors 22*a*, b pass through cover 24 and allow electrical power to be passed to the inserted bulb through the contact means of the socket as will be described herein.

Figure 3:
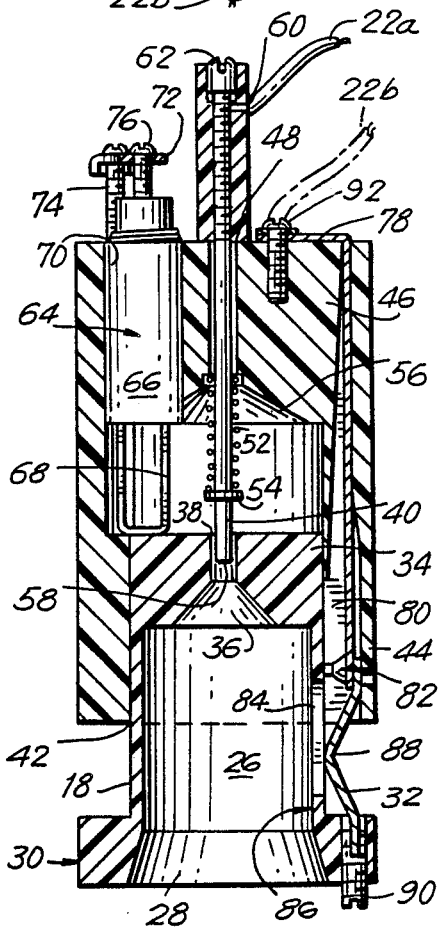
FIG. 3 is a sectional elevation view taken along line 3—3 of FIG. 2 depicting the socket with the cup in the extended position.

As may be seen in FIGS. 3–5, cup 18, which may be manufactured from plastic or similar insulating material, is provided with a circular bulb base-receiving bore 26 having a diameter slightly greater than that of the threaded contact portion 14 of bulb 12. The distal portion 28 of the bore may be slightly flared to assist in insertion of the bulb and to allow accommodation of the flaring portion of the bulb adjacent the threaded contact portion. Cup 18 is further provided with a circular shoulder 30 which carries adjustment screw 90 for contact activating cam arm 32.

The base portion 34 of cup 18 is provided with an inwardly directed conical depression 36, the base of which communicates with bore 26 and is dimensioned to accept the central contact 6 of the light bulb. At the apex of depression 36 is through-bore 38, adapted to allow the passage of central conductor rod 40 in a manner to be described infra.

Cup 18 fits within circular bore 42 in frame 20, which is similarly constructed of plastic or other appropriate insulating material. The frame 20 comprises circular wall portion 44 about bore 42, as well as base portion 46. Axial through-bore 48, aligned with through-bore 38 in cup 18, supports central conductor rod 40, which is terminated at its upper end by insulated stop member 50. Central conductor rod 40 is spring-biased by spring 52 positioned and loaded between fixed member 54 on conductor rod 40 and conical depression portion 56 of through-bore 48 in frame base portion 46 such that conductor rod end 58 extends into cup through-bore 38. The length of central conductor rod 40 and insulating stop 50 are chosen such that when cup 18 is in the extended position, as shown in FIG. 3, end 58 of conductor rod 40 is withdrawn within cup through-bore 38, but when cup 18 is in the retracted position, such as in FIG>4, end 58 projects into conical depression 36 of the cup, allowing contact to be made with the central conductor 16 of the inserted bulb. When in such a position, spring 52 allows the precise position of central conductor rod 40 to accommodate contact with the bulb central conductor while maintaining electrical connection therewith. Conductor 22a establishes connection to the electrical mains with central conductor rod 40, and is connected thereto through side bore 60 in insulated stop member 50, contact being maintained with conductor rod 40 by set screw 62.

Figure 2:
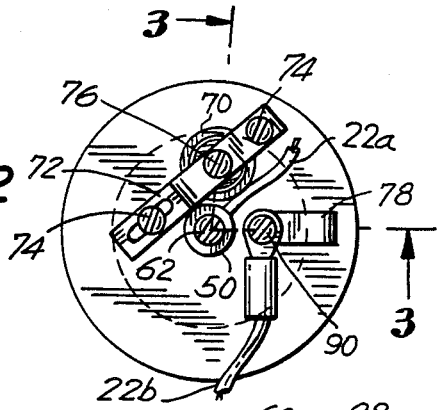
FIG. 2 is a top plan view taken along line 2-2 of FIG. 1, illustrating the electrical connections to the socket.

Also mounted to base portion 46 of frame 20 and communicating with cup 18 is latch mechanism 64, whose operation controls the positioning of the cup within frame bore 48. As may be seen, the latch mechanism 64 includes a latch body 66 and a projecting latch arm 68 which is affixed to cup 18 by appropriate means, such as a screw, adhesive or the like (not shown). In operation, latch arm 68 is movable from a first, extended position, as illustrated in FIG. 3, to a second, retracted position as shown in FIG. 4. An additional, slight further retraction of the latch arm releases the arm which is spring-loaded, from the retracted position for return to the extended position. Such latch mechanisms are commercially available devices. Latch mechanism 64 is mounted within an accepting bore 70 within frame base portion 46 and may be maintained therein by use of a variety of mechanisms, such as a clamp arm 72, as may be best seen in FIG. 2, which is affixed to frame 20 by screws 74. An adjustment screw 76 bears upon the end of latch body 66 to retain the mechanism in position in bore 70 and permit a degree of longitudinal adjustment of its position therein.

Side contact 78, adapted to engage the threaded contact 14 of bulb 12, is in the form of a generally L-shaped resilient member and is located in a longitudinal channel 80 in frame 20. It includes inwardly-directed pointed head portion 82 at its distal end. Channel 80 is of generally flared configuration, as may be seen in FIGS. 3–5, to allow the head end of contact 78 to flex towards and away from cup 18. In particular, as cup 18 is retracted into frame 20, cam arm 32 slides along channel 80 and engages and drives contact head portion 82 through opening 84 in cup side wall 86 so as to engage a thread root of threaded base contact 14 on bulb 12 as may be best seen in FIGS. 4 and 6. The longitudinal position of cam arm 32 may be adjusted by screw 90, such that maximum penetration of head 82 through cup wall 86, which occurs upon contact with cam knee portion 88, occurs at a point proximate a root, rather than a crest, of bulb threaded contact 14. Electrical contact to threaded contact 14 is accomplished through conductor 22*b*, which is electrically joined to side conductor 78 by set screw 92 mounted into frame base 46, which also fastens side conductor 78 to the frame.

Operation of the socket is as follows: In its initial position, as shown in FIG. 3, cup 18 is in the extended position, whereby both central conductor 40 and head 82 of side conductor 78 are retracted and do not extend into the cup. Upon insertion of a light bulb into the socket, as shown in FIG. 4, cup 18 is driven to the retracted position, whereby end 58 of central conductor 40 projects through cup through-bore 38, establishing electrical connection with the top contact 16 of the bulb, and head 82 of side conductor 78 is driven by cam arm 32 into contact with a root of bulb threaded contact 14. At the same time, latch arm 68 is depressed by the cup 18, and latches in the retracted position retaining the cup 18 in the retracted position. Head 82, in contact with a thread root by cam arm 32, retains the bulb 12 within the cup and socket without the necessity of a screwing insertion action.

When the bulb 12 is desired to be removed, an additional small axially inward motion of the bulb, as shown by the arrow in FIG. 4, causes latch mechanism 64 to release latch arm 68, its spring action driving cup 34 back to the extended position, as shown in FIG. 5. This motion, which moves the knee 88 of cam arm 32 out of contact with side conductor 78, allows side conductor head 82 to retract through the cup side wall 86, both releasing the bulb from the grip of the socket and ending electrical contact with the bulb thread contact. Central conductor rod 40 similarly withdraws from the cup interior, thus terminating electrical conduct with bulb top contact 16. The bulb is now released from the socket cup, the interior surfaces of which are free from current-carrying protrusions which would otherwise provide for electrical contact points.

I claim:

1. An improved light socket for use with light bulbs having a base including a first, central electrical contact and a mounting thread forming a second electrical contact, said socket comprising a frame and a cup adapted to accept the bulb base mounted for longitudinal motion within said frame between a first extended position and a second retracted position, first means operatively joined to said cup for establishing electrical contact with the bulb and second means operatively joined to said cup for retaining said bulb in said cup, said first and second means being engaged with said bulb when said cup is in the second retracted position and disengaged from said bulb when said cup is in the first, extended position, wherein said first means comprise first and second electrical contacts mounted to said frame, said first electrical contact extending coaxial with the direction of cup travel through an aperture in the bottom of said cup, said first contact projecting through the bottom of said cup for contact with said central contact of the bulb when said cup is in the retracted position, said second electrical contact projecting through the side of said cup when said cup is in the retracted position for contact with the mounting thread contact of the bulb.

2. The apparatus of claim 1, wherein said first electrical contact is in the form of a spring-biased rod.

3. The apparatus of claim 1, wherein said longitudinal motion is controlled by two-position means mounted to said cup and said frame.

4. The apparatus of claim 1, wherein said second means comprises cam means mounted to said cup engageable with a flexible conductor element mounted to said frame, said conductor element having a head portion adapted to project through an aperture in the side of said cup to engage said threaded portion of said bulb.

5. The apparatus of claim 4, wherein said second means comprises said head portion of said conductor element.

6. The apparatus of claim 5, wherein said flexible conductor element is located within a flared groove in said frame.

7. Electrical socket apparatus comprising a frame, means mounted in said frame for longitudinal motion between a first extended position and a second retracted position, said means being dimensioned and adapted to embrace the contact-bearing portion of an inserted electrical device, latch means mounted to said frame and embracing means for selectively retaining said embracing means in said first and second positions, electrical contacts mounted on said frame for engagement with corresponding contacts on the inserted electrical device, said electrical contacts extending within said embracing means to establish said engagement when said embracing means is in the second, retracted position and being retracted from the interior of said embracing means when said embracing means is in the first, extended position, and means mounted with respect to said frame to selectively retain the inserted electrical device within said embracing means when said embracing means is in the second, retracted position and release the device when said embracing means is in the first, extended position.

* * * * *